United States Patent [19]

Sahni

[11] 4,041,345

[45] Aug. 9, 1977

[54] BLUE COLOR AC GAS DISCHARGE DISPLAY PANEL AND METHOD

[75] Inventor: Omesh Sahni, Yorktown Heights, N.Y.

[73] Assignee: International Business Machines Corporation, Armonk, N.Y.

[21] Appl. No.: 645,593

[22] Filed: Dec. 31, 1975

[51] Int. Cl.[2] ..... H01J 61/12

[52] U.S. Cl. ..... 313/225; 313/185

[58] Field of Search ..... 313/225, 226, 185

[56] References Cited

U.S. PATENT DOCUMENTS 3,886,393 5/1975 Hinson ..... 313/225 X

FOREIGN PATENT DOCUMENTS 17,291 3/1973 Japan

*Primary Examiner*—Rudolph V. Rolinec
*Assistant Examiner*—Darwin R. Hostetter
*Attorney, Agent, or Firm*—John A. Jordan

[57] ABSTRACT

A blue color AC gas discharge display panel is obtained by the room-temperature Hg vapor seeding of high pressure Ar gas as the luminous gas mixture. Typically, the panel uses room-temperature Hg (approximately 3m Torr) in several hundred Torr of argon. Generally, good resolution is achieved in standard AC panels in at least 300 Torr. The upper limit is nominally one atmosphere. This gives an Hg seeding of less than 0.001% of the total gas pressure. Thus, direct electron excitation of Hg atoms is negligible and the discharge condition involves only the excitation of argon atoms by the electrons.

15 Claims, 5 Drawing Figures

BLUE COLOR AC GAS DISCHARGE DISPLAY PANEL AND METHOD

BACKGROUND OF THE INVENTION

1. Field of the Invention

The present invention relates to AC gas discharge display and memory panels. More particularly, the present invention relates to a blue color AC gas discharge display and memory panel exhibiting high luminous efficiency.

2. Description of the Prior Art

One of the limitations of the conventional AC gas discharge display panel, typically utilizing neon/argon as the luminous gas mixture, resides in the fact that such gas produces a reddish-orange color. The reddish-orange color is objectionable for a variety of human-factors reasons. For example, under certain ambient light conditions, such as use in sun light, the reddish-orange color is difficult to see. The use of gas mixtures, other than those with a dominant percentage of neon, to give direct emission of alternative colors has historically been found to be not satisfactory, since the luminous efficiencies achieved from such alternative gas mixtures are too low. Accordingly, as heretofore obtained in the art, the requirement for good luminous efficiencies necessitated the use of gas mixtures having a dominant percentage of neon and an acceptance of the reddish-orange color obtained therefrom.

Alternative color capability in gas discharge display panels has been pursued by an indirect method. Basically, this indirect method utilizes photosensitive phosphors in the active discharge region, which phosphors are stimulated by uv emission from a suitable gas mixture. Various arrangements have been implemented in the prior art utilizing this principle. However, since the principle utilizes phosphors stimulated by emission from the gas, additional and somewhat complex fabrication is required, and brightness and efficiencies are lost. Typical of the prior art gas discharge display panel utilizing this approach is that described by Brown et al in an article entitled "A Multicolor Gas-Discharge Display Panel," appearing in the proceedings of the S.I.D., Vol. 13, First Quarter 1972.

The use of Ar-Hg gas mixtures has heretofore been used in the lamp industry. The conventional fluorescent lamp utilizes such a mixture. However, the fluorescent lamp uses a low Ar pressure of typically 2.5 Torr with an optimum Hg vapor pressure of 6–10m Torr obtained by running the tube with a wall temperature of approximately 40° C. Thus, in such an arrangement, the Hg vapor pressure is always greater than approximately 0.25% of the bulk gas pressure and the discharge conditions are optimized for electron excitation of uv resonance radiation of Hg. As will be more fully explained, the present invention uses room-temperature Hg in at least 300 Torr of Ar.

It has also been known in the prior art to use high-pressure Hg lamp mixtures. Typically, such lamps use 25 Torr of Ar and well over one atmosphere of Hg vapor pressure during operation. Also known in the prior art are high-pressure Hg-vapor lamps typified by U.S. Pat. No. 2,240,353 to Schnetzler, and high-pressure Ar lamps typified by U.S. Pat. No. 2,241,968 to Suits. Typical of the high-pressure Hg lamp mixture (with Ar) is that described in U.S. Pat. No. 2,761,086 to Noel et al.

The introduction of Hg vapor into DC gas discharge display panels is also known in the art. However, the Hg vapor is introduced into these cold cathode-type display devices for purposes of inhibiting sputtering. Typical of such prior art approaches is that described by Fehnel in U.S. Pat. No. 3,828,218 and Kupsky in U.S. Pat. No. 3,580,654.

SUMMARY OF THE INVENTION

In accordance with the principles of the present invention, a blue color AC gas discharge display panel is provided by utilizing the room-temperature Hg vapor seeding of high pressure Ar gas as the luminous gas mixture. Typically, the panel uses room-temperature Hg (approximately 3m Torr) in at least 300 Torr to 1 atmosphere of Ar. This, typically, gives an Hg seeding of less than 0.001% of the total gas pressure. Accordingly, direct electron excitation of Hg atoms is negligible, and the discharge condition favors the excitation of Ar metastable states. High luminous efficiency of this gas mixture provides good panel luminosity and operating voltage margin.

It is, therefore, an object of the present invention to provide an improved AC gas discharge display panel.

It is a further object of the present invention to provide an improved blue color AC gas discharge display panel.

It is yet a further object of the present invention to provide a blue color AC gas discharge display panel which exhibits high luminous efficiency resulting in good panel luminosity and acceptable operating voltage margins.

It is yet still a further object of the present invention to provide an AC gas discharge display panel which utilizes, as the luminous gas mixture thereof, high-pressure Ar gas seeded with room-temperature Hg vapor.

It is another object of the present invention to provide an alternate color to the orange-red color characteristic of neon-based gas mixtures.

It is yet another object of the present invention to provide a blue-green color AC gas discharge display panel utilizing a gas mixture having high-luminous efficiency with the luminosity of the panel used directly to indicate the information to be displayed on the panel.

The foregoing and other objects, features and advantages of the invention will be apparent from the following more particular description of the preferred embodiments of the invention as illustrated in the accompanying drawings.

DETAILED DESCRIPTION OF THE DRAWINGS

Although it is generally believed that only neon-based gas mixtures have sufficient luminosity to be the active visible light-emitting medium in gas discharge display devices operating at or near ambient room temperature, it has been discovered, in accordance with the present invention, that the room-temperature Hg vapor seeding of high-pressure Ar gas provides a gas mixture which exhibits sufficient luminosity to be the active visible (blue-green) light-emitting medium in AC gas discharge display devices. Thus, the present invention provides an alternative to the orange-red color characteristic of neon.

Figure 1B:
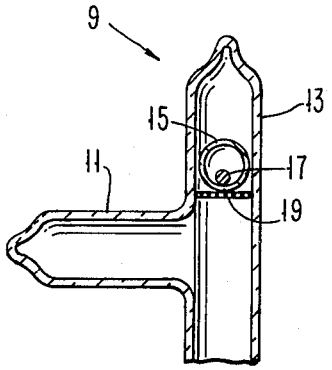
FIG. 1B depicts an enlarged view of the panel tubulation shown in FIG. 1A.
Figure 1A:
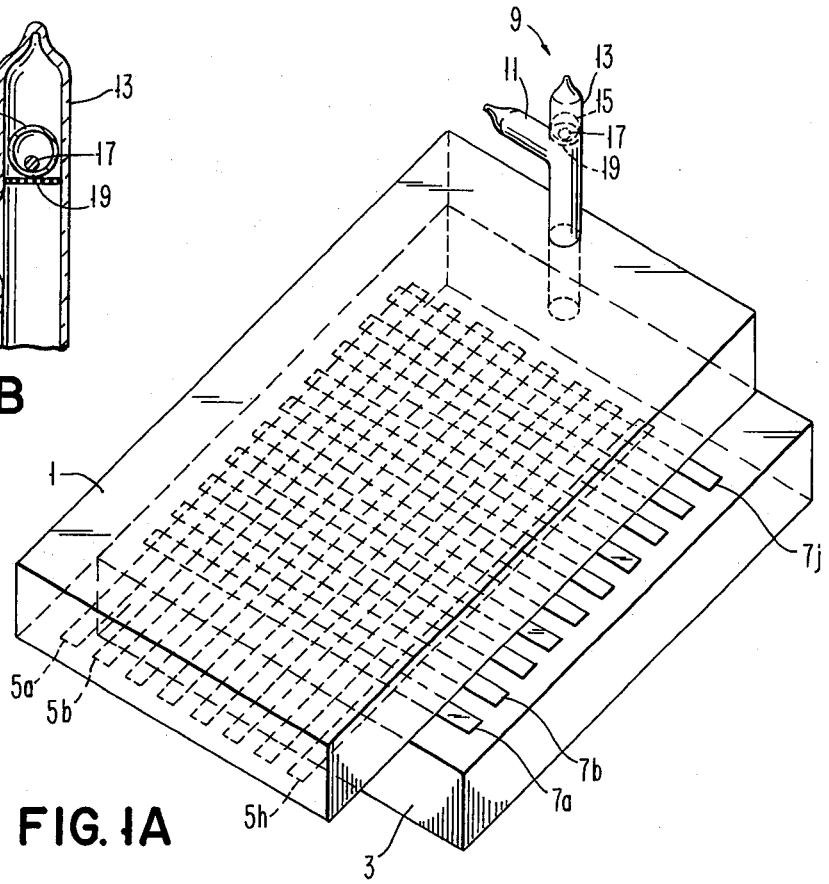
FIG. 1A represents a typical AC gas discharge display panel configuration shown in perspective.

FIG. 1A shows a conventional AC gas discharge display panel arrangement. As is understood by those skilled in the art, the panel comprises an Upper Glass Plate 1 separated from and sealed to a Lower Glass Plate 3 so as to provide an intervening chamber which is typically filled with a neon/argon gas mixture and, in accordance with the present invention, is filled with high-pressure Ar seeded with room-temperature Hg.

In conventional fashion, electrically conductive Parallel Lines *5a-5h* are disposed on the lower side of the Upper Plate 1, and as is familiar to those skilled in the art, they serve as electrodes for supplying a given electrical signal to the intervening sealed chamber between the plates. Electrically conductive Parallel Lines *7a-7j* are disposed on the upper side of the Lower Glass Plate 3 and, in similar fashion, serve as electrodes for supplying a given electrical signal to the other side of the intervening sealed chamber between the plates. Typically, the sets of parallel lines are orthogonal to one another and comprise, for example, Cr-Cu-Cr conductors. The lines on each plate are coated with a dielectric glass which glass is, in turn, coated with a refractory layer, such as MgO.

In order to evacuate the intervening sealed chamber between Plates 1 and 3 and fill with the luminous gas, a tubulation assembly is provided, as shown at 9 in FIG. 1A. In conventional manner, two Branches 11 and 13 are shown. Typically, one branch is connected to a vacuum pump and the other branch to a source of luminous gas. For example, Branch 11 may be coupled to a vacuum pump, and Branch 13 coupled to a source of luminous gas. It is evident that other arrangements may readily be employed. For a typical manner in which AC gas discharge display panels may be fabricated, reference is made to U.S. Pat. No. 3,837,724 to Haberland et al.

It should be understood that the particular configuration and details of the gas panel arrangement, and the manner in which it is fabricated, are not a part of the present invention. It is only significant insofar as the present invention is concerned that the gas discharge display panel operate in the AC mode. Any of a variety of configurations and fabrication techniques may be employed to produce the ultimate panel which is to operated in the AC mode. FIGS. 1A and 1B are shown by way of background, with FIG. 1B showing an enlarged view of the tubulation of a conventional panel, which tubulation may be conveniently used as one means for readily effecting the room-temperature Hg vapor seeding of high-pressure Ar gas. However, as is understood by those skilled in the art, any of a variety of techniques may be employed to effect the room-temperature Hg vapor seeding of the high-pressure Ar. Obviously, the schemes for effecting this may vary from a relatively simple scheme as shown in FIG. 1B to much more sophisticated assemblies and process steps.

With reference to FIG. 1B, there is shown Capsule 15 containing a Ball of Hg 17. The Capsule 15 is held in place by Screen 19. It should be understood that FIG. 1B is not to scale, but is shown merely to depict the general approach by which one may seed high-pressure Ar gas with room-temperature Hg vapor.

Capsule 15 may be fabricated from any of a variety of materials which respond to some form of radiation so as to be eruptible. For example, Capsule 15 may be fabricated from a glass or polymer which is infra-red absorbing. Alternatively, Capsule 15 may be fabricated from a material that ruptures in response to heat from a laser beam.

Branch 11, for example, in FIG. 1A may be coupled to a vacuum pump and Branch 13 to a source of Ar gas in a manner so as to be selectively isolated from Tubulation 9. Typically, the Ar gas may be coupled to Branch 13 via an outlet valve which may be closed. With the outlet valve closed, the vacuum pump connected to Branch 11 acts to evacuate the intervening sealed chamber between Plates 1 and 3 to the desired pressure. It is understood that any of a variety of techniques may be used for this evacuation process. For example, successive evacuation and backfilling may be used, as may be deemed appropriate. With the intervening sealed chamber evacuated to the desired pressure, the vacuum pump coupled to Branch 11 may be isolated by a valve, or the like, and the source of Ar gas admitted via Branch 13. In this regard, the gas may pass around Capsule 15 and into the evacuated chamber between the plates. After the desired Ar pressure has been reached, Branches 11 and 13 of Tubulation 9 may be tipped off, as shown in FIG. 1B. As an alternative, it is evident that Branch 11 may be used as both the evacuation port and the Ar gas admitting port.

After the intervening sealed chamber in FIG. 1A has backfilled with pure Ar gas to a relatively high pressure, Capsule 15, as shown in FIG. 1B, is erupted by the application of infra-red energy, for example, to thereby release Hg 17 encapsulated therein. An alternate scheme which is thought to improve overall panel uniformity is to erupt the Capsule 15 before admitting Ar gas. Now the overall panel assembly, as shown in FIG. 1A, is heated in vacuum to a temperature of about 100° C while being kept isolated from the vacuum system and gas line by a cold trap and a valve. The greatly increased pressure of Hg vapor at this temperature ensures uniform contact of Hg vapors with the panel surfaces. The whole assembly is now allowed to cool down to room temperature and then, Ar gas is filled to the desired pressure.

It should be understood that high luminous efficiency in accordance with the present invention may be achieved over a relatively wide range of high-pressure Ar. In this regard, the Ar pressure may range from approximately 100 Torr to 1 atmosphere. Good resolution of individual cells is achieved for a typical AC panel in at least 300 Torr of Ar. As will be explained more fully hereinafter, FIGS. 24 depict the results of room-temperature Hg seeding of 520 Torr of Ar.

It should be recognized that with Hg 17, as shown in FIG. 1B, for example, at room temperature (approximately 3m Torr) in at least 300 Torr of Ar, an Hg seeding of less than 0.001% of the total gas pressure in the intervening sealed chamber is obtained. Accordingly, direct electron excitation of Hg atoms is negligible, and the discharge condition favors the excitation of Ar metastable states. In this regard, it should be appreciated that light-emitting AC gas discharge operation in accordance with the luminous gas mixture utilized in the present invention basically involves a three-step operation. The first step involves populating the main source, i.e., Ar, to a metastable state. The second step involves a collisional energy transfer (Penning ionization) from the Ar metastable states to the Hg atoms to form Hg ions. Then, in the third step the Hg ions in turn recombine with electrons to form Hg atoms and thereby give off blue-green light.

It should be appreciated that the mechanics of the luminous gas discharge in accordance with the present invention is a result of both the AC mode of operation and the particular gas mixture employed. As is understood by those skilled in the art, AC operation involves a memory or storage effect achieved by charging up the capacitance across a given cell which capacitance is a result of, at least in part, the dielectric overcoat on the conductive lines. As is understood, alternate sides of the cell charge up with alternate polarity on alternate half cycles of the AC signal. Within a given half cycle, when the cell has reached a fully charged condition, the voltage across the intervening gas of the cell drops to approximately zero. This alternate charging over half cycles occurs relatively rapidly. Typically, for example, a cell will charge within 1 or 2 microseconds of a 15 microsecond half-cycle time interval. Accordingly, in this example, this would leave a 13 to 14 microsecond interval where the field across the gas is zero. This zero-field time gives the electrons sufficient time to cool so as to thereby permit an efficient recombination with the Hg ions, i.e., the electrons have enough time to thermalize.

Accordingly, the combination of an AC mode of operation with the particular luminous gas mixture employed herein act to provide the necessary conditions to achieve efficient luminosity in the blue-green range. In this regard, it should be appreciated that the AC gas discharge display panel operates on a principle of bistability, i.e., bistable storage, and that the particular gas mixture employed in accordance with the present invention exhibits the bistable characteristics required for AC operation. Typically, pure neon or helium, for example, do not show the bistability, i.e., the bistable hysterisis characteristic. The AC mode of operating a gas discharge display device should be contrasted with a DC mode of operating such a device. In the DC mode, the panel does not achieve a zero field condition and therefore always has heated electrons present within the intervening sealed chamber. The heated electrons would preclude efficient Hg discharge light emission. Accordingly, efficient display panel operation, in accordance with the present invention, is based upon the absence of heated electrons during the zero field condition of the AC mode of operation. In addition, efficient operation is also based upon the apparent favorable energy match between the Ar metastables (11.5eV) and the ionization level (10eV) of the Hg atoms.

Figure 2:
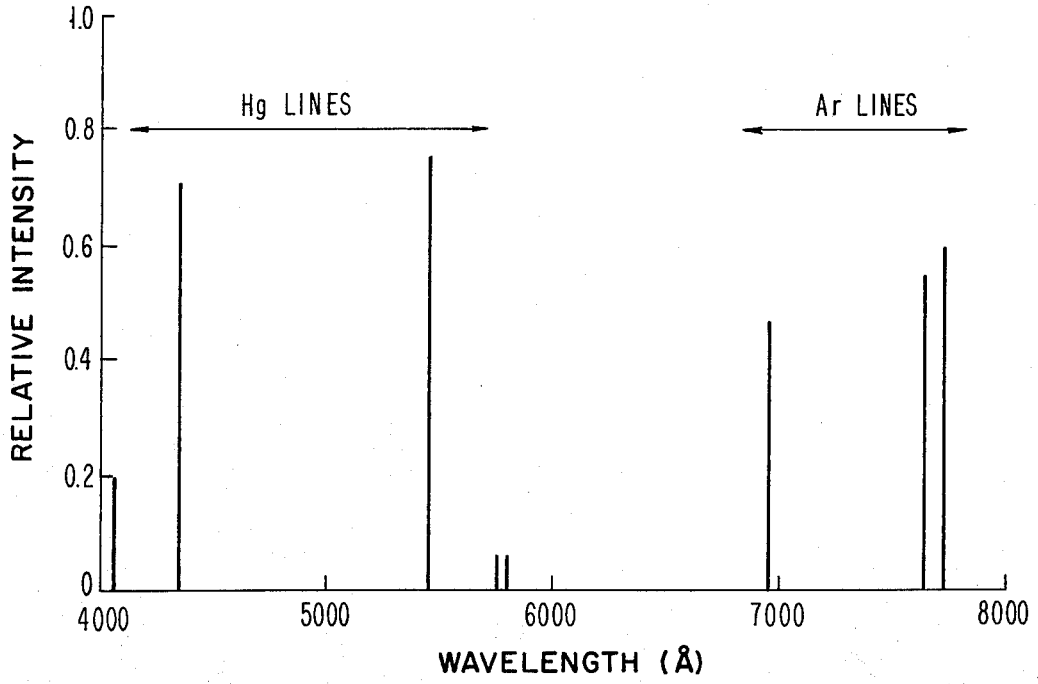
FIG. 2 shows the spectral intensity distribution of the light output from an AC gas discharge display panel containing room-temperature Hg seeding of approximately 520 Torr of Ar.

With reference to FIG. 2, there is shown the spectral intensity distribution of the light output from an AC gas discharge display panel containing room-temperature Hg seeding of 520 Torr of Ar. As can be seen, the visible region is completely dominated by the Hg lines and the intensity of the strongest line (5461 A) of Hg is comparable to the strong infra-red emission lines of Ar, even though the saturated vapor pressure of Hg is approximately only $10^{-5}$ times the Ar pressure. In addition, it can be seen that the major portion of the radiant energy in the visible is almost equally divided between the 5461 A green line (45%) and the 4358 A blue line (43%). Since the relative response of the human eye peaks in the green, the introduction of a narrow band pass filter centered at 5461 A would give a green color display panel without appreciable reduction in brightness. The relatively large concentration of visible radiant energy in the green Hg line offers the decided advantage of reducing the reflected glare from the panel surface in bright ambient situations by using a narrow band pass filter and antireflective coating on the viewing surface of the panel. As can be appreciated, with Hg in the blue-green region and Ar in the purple-red and mostly infra-red region, the transparency of the latter is important for obtaining the desired blue-green color emission in accordance with the present invention. It is evident that other gases such as neon, for example, exhibit too much red-orange emission for the blue-green Hg emission to come through such that the Hg emission would act to be visibly greater than the Ne emission.

Figure 3:
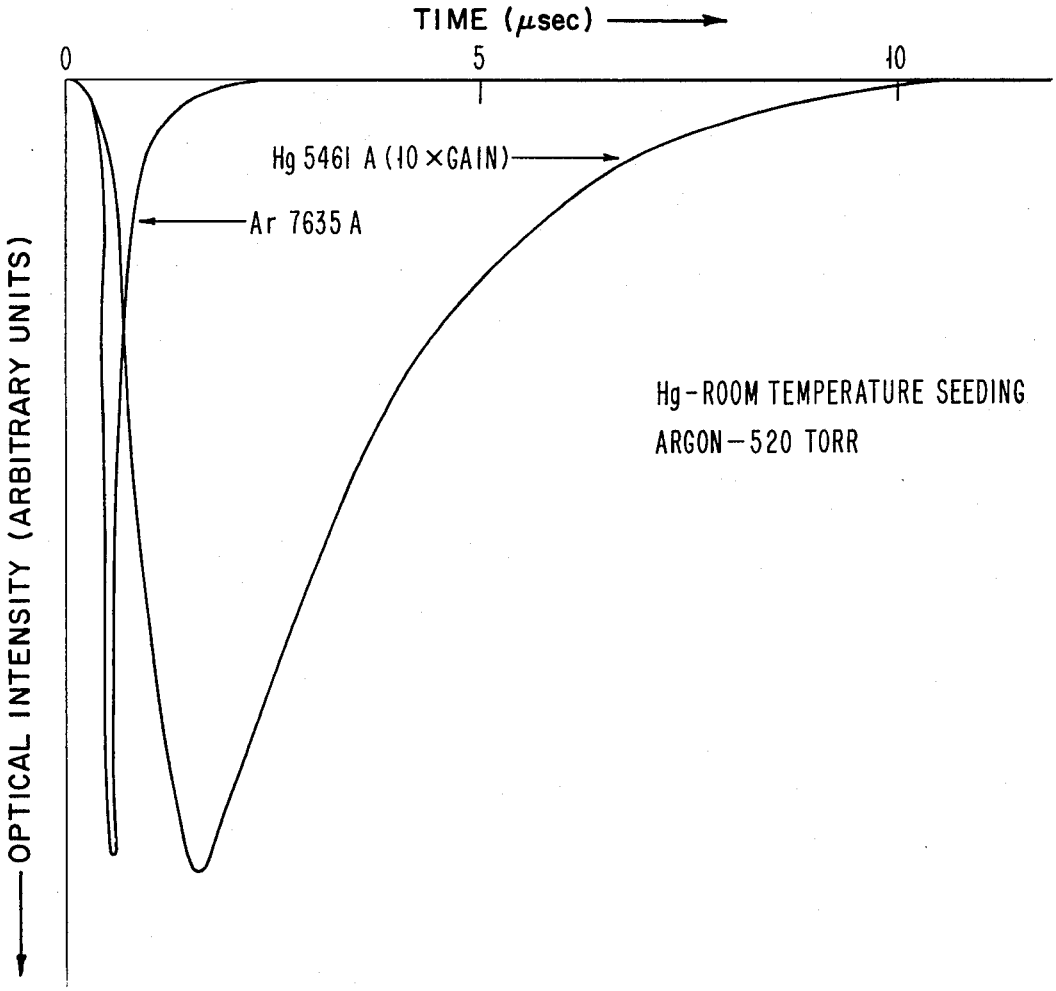
FIG. 3 shows the time dependence of the Hg emission line represented in FIG. 2.

The time dependence of the Hg emission line, shown in FIG. 3, clearly demonstrates that the peak intensity occurs at a time well beyond the active discharge represented by the Ar emission line. This occurrence of peak emission in the quenched discharge period, i.e., zero-field condition interval, indicates a collisional energy transfer from the Ar metastable states to the Hg atoms as hereinabove described.

Figure 4:
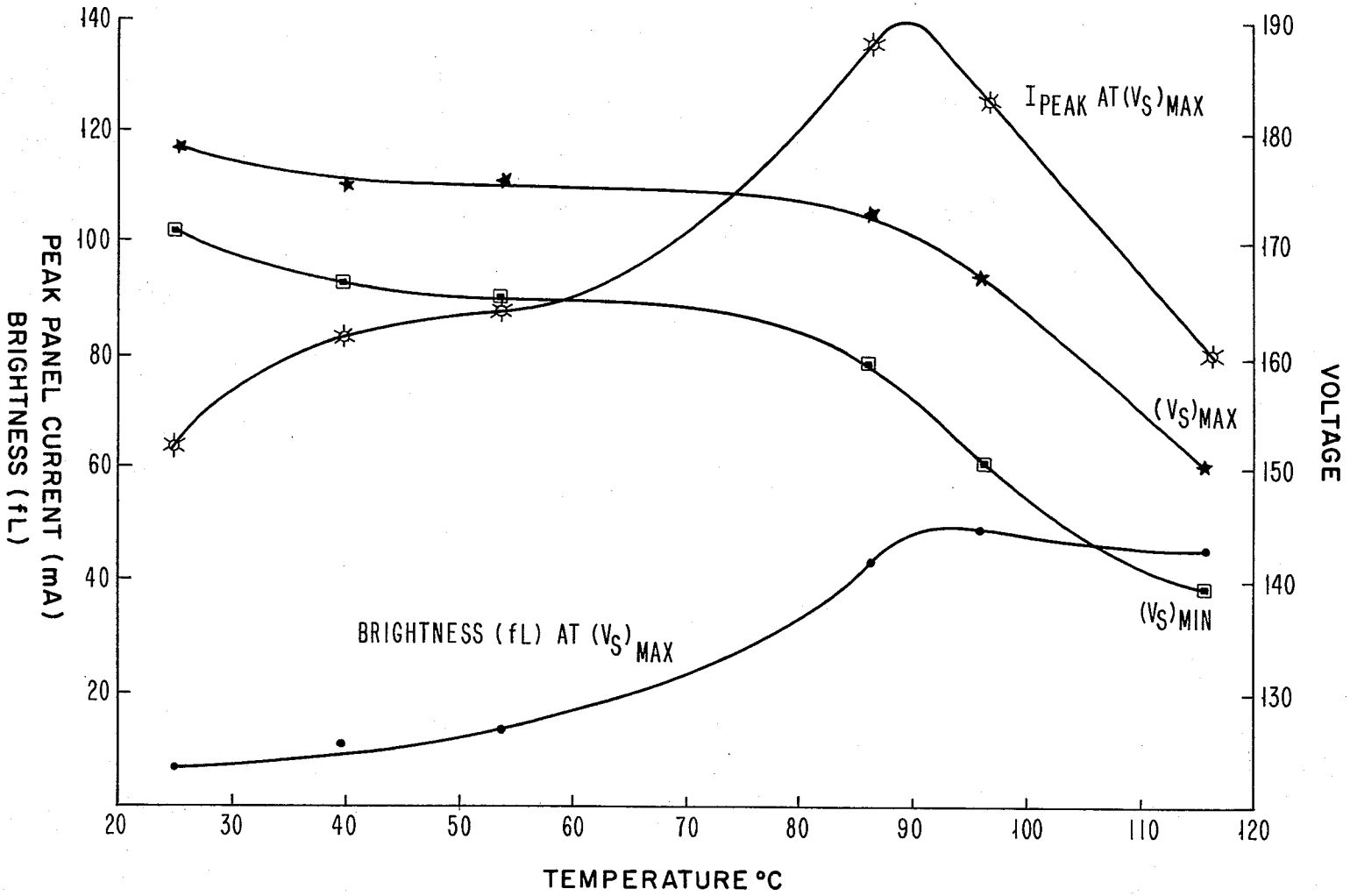
FIG. 4 shows the dependence of certain device parameters of the sealed-off panel as a function of ambient temperature.

FIG. 4 shows the dependence of peak panel current and brightness in a panel fabricated in accordance with the present invention, as a function of ambient temperature. As can be seen, both the brightness and peak current show a maximum at approximately 90° C. This temperature corresponds to a saturated vapor pressure of approximately 0.2 Torr, which gives an Hg seeding of approximately 0.04%. At this level of Hg seeding, the Penning ionization is apparently high enough to explain the decreasing operating voltages with increasing ambient temperature.

Reference has been made hereinabove to the use of a dielectric overcoat, such as MgO. It should be understood that a variety of overcoats may be employed in this regard but that it is possible that the Hg in the luminous mixture of the present invention combines with MgO to give a higher local pressure, i.e., there may be a special interaction between the two such that the very high efficiencies are achieved.

While the invention has been particularly shown and described with reference to preferred embodiments thereof, it will be understood by those skilled in the art that various changes in form and details may be made therein without departing from the spirit and scope of the invention.

I claim:

1. In an AC gas discharge display panel having a luminous ionizable gaseous medium therein and an open panel structure exhibiting characteristics such that said gaseous medium may periodically be driven by the drive voltage therefor to a substantially zero voltage condition thereacross, the improvement comprising an argon-based gaseous medium seeded with mercury vapor to provide a luminous gaseous medium which exhibits blue-green emission due to the efficient recombination of mercury ions during said zero voltage condition.

2. The AC gas discharge display panel set forth in claim 1 wherein said argon-based gaseous medium comprises argon in a pressure range between 100 Torr and one atmosphere.

3. The AC gas discharge display panel set forth in claim 2 wherein said argon is at least at 300 Torr and is seeded with room-temperature mercury vapor to give a mercury seeding of less than 0.001% of the total argon-based gaseous medium pressure.

4. The AC gas discharge display panel set forth in claim 3 wherein said display panel includes tubulation means and said argon is seeded with room-temperature mercury in said tubulation means.

5. The AC gas discharge display panel set forth in claim 3 wherein argon at approximately 520 Torr is seeded with room-temperature mercury vapor.

6. The AC gas discharge display panel as set forth in claim 2 wherein said gas discharge panel structure device includes respective dielectric layers covering the sets of conductive lines on each of the opposing glass plates thereof with said dielectric layers each including a high secondary emission refractory layer deposited thereon with the surface of one side thereof in contact with said argon-based gaseous medium seeded with said room-temperature mercury vapor.

7. The AC gas discharge display panel as set forth in claim 6 wherein said high secondary electron emission refractory layer is a MgO layer.

8. In an article of manufacture comprising an AC gas discharge display panel containing therein a luminous ionizable gaseous medium sealed between a pair of opposing plates each of which has deposited on the internal surface thereof sets of conductive lines covered with at least one layer of material exhibiting dielectric properties such that substantially all of the drive voltage for said panel is periodically transferred thereto so as to establish a substantially zero field condition across said gaseous medium, the improvement wherein the luminous ionizable gaseous medium is a high-pressure argon-based gaseous medium seeded with mercury vapor.

9. The AC gas discharge display panel set forth in claim 8 wherein said high-pressure argon is at least at 300 Torr to one atmosphere pressure so as to give a mercury seeding of less than 0.001% of the total gas pressure.

10. The AC gas discharge display panel set forth in claim 8 wherein said high-pressure argon is between 100 Torr and one atmosphere pressure and is seeded with room-temperature mercury vapor.

11. The AC gas discharge display panel set forth in claim 10 wherein said at least one layer of material exhibiting dielectric properties includes a high secondary emission refractory layer.

12. The AC gas discharge display panel set forth in claim 11 wherein said refractory layer is a MgO layer.

13. In an AC gas discharge display arrangement including a gas discharge display panel containing a luminous gas in an array of selectively addressable cells within said panel with the luminosity of addressed cells being sustained in response to an alternating voltage applied across said cells so that substantially all of said alternating voltage is periodically dropped across insulating layers therein, the improvement wherein the luminous gas is a high-pressure argon-based gas seeded with room-temperature mercury vapor.

14. The AC gas discharge display panel set forth in claim 13 wherein said high-pressure argon gas is at 300 Torr to one atmosphere pressure so as to give a mercury seeding of less than 0.001% of the total gas pressure.

15. The AC gas discharge display panel set forth in claim 13 wherein said mercury vapor is admitted to an evacuated panel at an elevated temperature before said high-pressure argon gas is admitted so as to uniformly disseminate throughout said panel.

* * * * *